US011101531B2

(12) United States Patent
Wilkerson, Jr. et al.

(10) Patent No.: US 11,101,531 B2
(45) Date of Patent: Aug. 24, 2021

(54) TRANSMISSION LINE WITH TUNABLE FREQUENCY RESPONSE

(71) Applicant: SMITHS INTERCONNECT, INC., Tampa, FL (US)

(72) Inventors: James Allan Wilkerson, Jr., Oldsmar, FL (US); Shawn Kalen O'Brien, Saint Petersburg, FL (US)

(73) Assignee: SMITHS INTERCONNECT, INC., Tampa, FL (US)

( * ) Notice: Subject to any disclaimer, the term of this patent is extended or adjusted under 35 U.S.C. 154(b) by 116 days.

(21) Appl. No.: 16/469,087

(22) PCT Filed: Dec. 21, 2017

(86) PCT No.: PCT/US2017/068013

§ 371 (c)(1),
(2) Date: Jun. 12, 2019

(87) PCT Pub. No.: WO2018/119305

PCT Pub. Date: Jun. 28, 2018

(65) Prior Publication Data

US 2019/0348733 A1 Nov. 14, 2019

Related U.S. Application Data

(60) Provisional application No. 62/438,317, filed on Dec. 22, 2016.

(51) Int. Cl.
*H01P 1/201* (2006.01)
*H01P 3/08* (2006.01)

(52) U.S. Cl.
CPC ..... *H01P 1/201* (2013.01); *H01P 3/08* (2013.01)

(58) Field of Classification Search
CPC ..... H01P 1/201; H01P 3/08
USPC ..... 333/209
See application file for complete search history.

(56) References Cited

U.S. PATENT DOCUMENTS

2003/0222732 A1 12/2003 Matthaei
2006/0006966 A1 1/2006 Kang et al.
2007/0200651 A1 8/2007 Kawai et al.
2008/0111652 A1* 5/2008 Abbaspour-Tamijani ..... H01P 1/20336 333/205
2015/0162886 A1 6/2015 Cherif

* cited by examiner

FOREIGN PATENT DOCUMENTS

EP 2083431 7/2009

*Primary Examiner* — Robert J Pascal
*Assistant Examiner* — Kimberly E Glenn
(74) *Attorney, Agent, or Firm* — Snell & Wilmer LLP

(57) ABSTRACT

A tunable filter for adjustable filtering between a minimum frequency and a maximum frequency includes a transmission line designed to transmit a signal and having longitudinal axis. The tunable filter further includes a two-dimensional capacitor array including step-tunable capacitors located along the transmission line, a first dimension of the two-dimensional capacitor array being along the longitudinal axis and a second dimension of the two-dimensional capacitor array being located perpendicular to the longitudinal axis. The tunable filter further includes a controller coupled to each of the step-tunable capacitors and designed to control each of the step-tunable capacitors independently to be in a biased mode or in an unbiased mode based on a desired frequency response of the tunable filter.

19 Claims, 7 Drawing Sheets

TRANSMISSION LINE WITH TUNABLE FREQUENCY RESPONSE

CROSS-REFERENCE TO RELATED APPLICATIONS

This application claims the benefit and priority of U.S. Provisional Patent Application No. 62/438,317, titled "Transmission Line With Tunable Frequency Response" and filed on Dec. 22, 2016, the entire contents of which are hereby incorporated by reference herein.

BACKGROUND

1. Field

The present disclosure generally relates to tunable filters and, more particularly, to tunable filters capable of operating over a large bandwidth and of performing multiple types of filter operations.

2. Description of the Related Art

Tunable filters may be used in various situations. For example, tunable filters may be used to isolate one or more signals that may be transmitted at different or varying frequencies or bandwidths, or to isolate one or more signals from a collection of signals at different frequencies.

Conventional tunable filters may be formed by placing discontinuities (such as irises, pins, tuning screws, or the like) at regular intervals along a transmission line that function to change impedance values along the transmission line. The spacing or distance between the discontinuities determines the center frequency of the filter (for example, the interval may be equal to half of the wavelength at the center frequency). The magnitude pattern of the discontinuities may determine the bandwidth in response shape of the filter (for example, larger discontinuities result in a narrower bandpath). Due to the set intervals and magnitude patterns of the discontinuities, such tunable filters may only operate within relatively narrow bandwidths.

Accordingly, tunable filters having adjustable frequency responses over a relatively large bandwidth are desirable.

SUMMARY

Disclosed herein is a tunable filter for providing an adjustable filter response between a minimum frequency and a maximum frequency. The tunable filter includes a transmission line designed to transmit a signal and having a longitudinal axis. The tunable filter further includes a two-dimensional capacitor array including a plurality of step-tunable capacitors located along the transmission line, a first dimension of the two-dimensional capacitor array being along the longitudinal axis and a second dimension of the two-dimensional capacitor array being located perpendicular to the longitudinal axis. The tunable filter further includes a controller coupled to each of the plurality of step-tunable capacitors and designed to control each of the plurality of step-tunable capacitors to be in a biased mode or in an unbiased mode based on a desired frequency response of the tunable filter.

Also disclosed is a tunable filter for providing an adjustable filter response. The tunable filter includes a transmission line designed to transmit a signal and having longitudinal axis. The tunable filter further includes a two-dimensional capacitor array including a plurality of step-tunable capacitors located along the transmission line, a first dimension of the two-dimensional capacitor array being along the longitudinal axis and a second dimension of the two-dimensional capacitor array being located perpendicular to the longitudinal axis, each of the plurality of step-tunable capacitors being equally spaced apart in the first dimension. The tunable filter further includes a controller coupled to each of the plurality of step-tunable capacitors and designed to control each of the plurality of step-tunable capacitors independently to be in a biased mode or in an unbiased mode based on a desired frequency response of the tunable filter.

Also disclosed is a transmission line tunable filter for adjusting impedance of a transmission line. The transmission line tunable filter includes an array of step-tunable capacitors each operating as a variable dielectric element and being configured to be in an unbiased mode or a biased mode, each step-tunable capacitor providing different impedance in the biased mode than in the unbiased mode. The transmission line tunable filter further includes a controller connected to the array of step-tunable capacitors. The controller is designed to determine one or more step-tunable capacitors in the array of step-tunable capacitors to be in the biased mode based on a desired frequency response. The controller is further designed to determine a biasing magnitude for each of the determined one or more step-tunable capacitors in the biased mode based on the desired frequency response. The controller is further designed to adjust the determined one or more step-tunable capacitors to be in the biased mode at the respective determined biasing magnitude.

BRIEF DESCRIPTION OF THE DRAWINGS

Other systems, methods, features, and advantages of the present invention will be or will become apparent to one of ordinary skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale, and may be exaggerated to better illustrate the important features of the present invention. In the drawings, like reference numerals designate like parts throughout the different views, wherein:

DETAILED DESCRIPTION

Described herein are tunable filters and methods for controlling a frequency response (i.e., "filter operation") of a tunable filter. Where used herein, a filter may refer to a transmission line with a transmission amplitude or phase characteristics that vary in any way with frequency.

The tunable filters include an array of step-tunable capacitors that are arbitrarily located along a transmission line. The step-tunable capacitors are likewise finely spaced, such as by a value equal to or less than an eighth of a wavelength of a maximum frequency of the tunable filter. The step-tunable capacitors may be evenly spaced throughout the transmission line, and may be placed adjacent to each other along two dimensions.

The tunable filters presented herein provide several benefits and advantages over conventional tunable filters. For example, due to the fine and even spacing of the step-tunable capacitors, the tunable filter may achieve more types of filter responses than other tunable filters. For example, the layout of the tunable filter allows the tunable filter to switch seamlessly between a bandpass filter and a band stop filter. Advantageously, the tunable filter may achieve frequency responses over a broader frequency spectrum than conventional tunable filters. Due to the various filter operations and to the relatively large bandwidth of operation, a single tunable filter as described herein may be used in place of a combination of multiple conventional filters, thus reducing a cost of a system that is required to filter signals that may be present within a large range of frequencies. Additionally, some embodiments of the tunable filter may be relatively inexpensive to manufacture.

Figure 1:
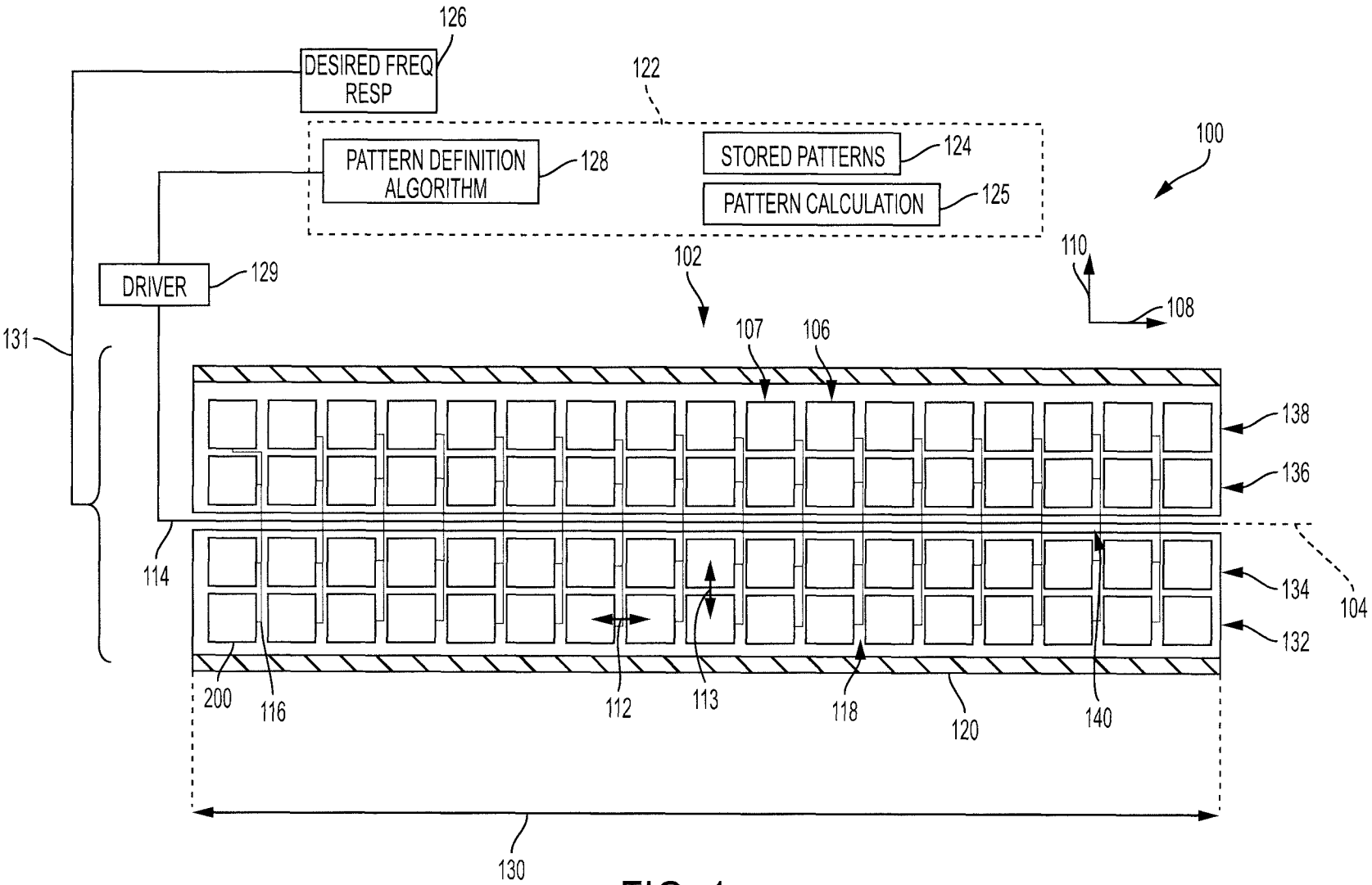
FIG. 1 is a drawing illustrating a cutaway top-down view of a tunable filter having a two-dimensional capacitor array with a plurality of finely-spaced step-tunable capacitors according to an embodiment of the present disclosure.

Referring to FIG. 1, the tunable filter 100 may be referred to as a transmission line tunable filter 100 because it may be implemented on a transmission line 102. The tunable filter 100 may be referred to as a tunable filter because it may change states to operate as different filters based on a control. For example, impedance values along the transmission line 102 may be adjusted to vary operation of the tunable filter 100 based on a desirable frequency response of the tunable filter 100. For example, the tunable filter 100 may be configured to operate as a bandpass filter and then immediately reconfigured to operate as a band stop filter. The tunable filter 100 may be designed to change filter behavior at relatively high speeds in order to modulate or demodulate signals as well as to perform static or slowly-varying filter functions.

Figure 2:
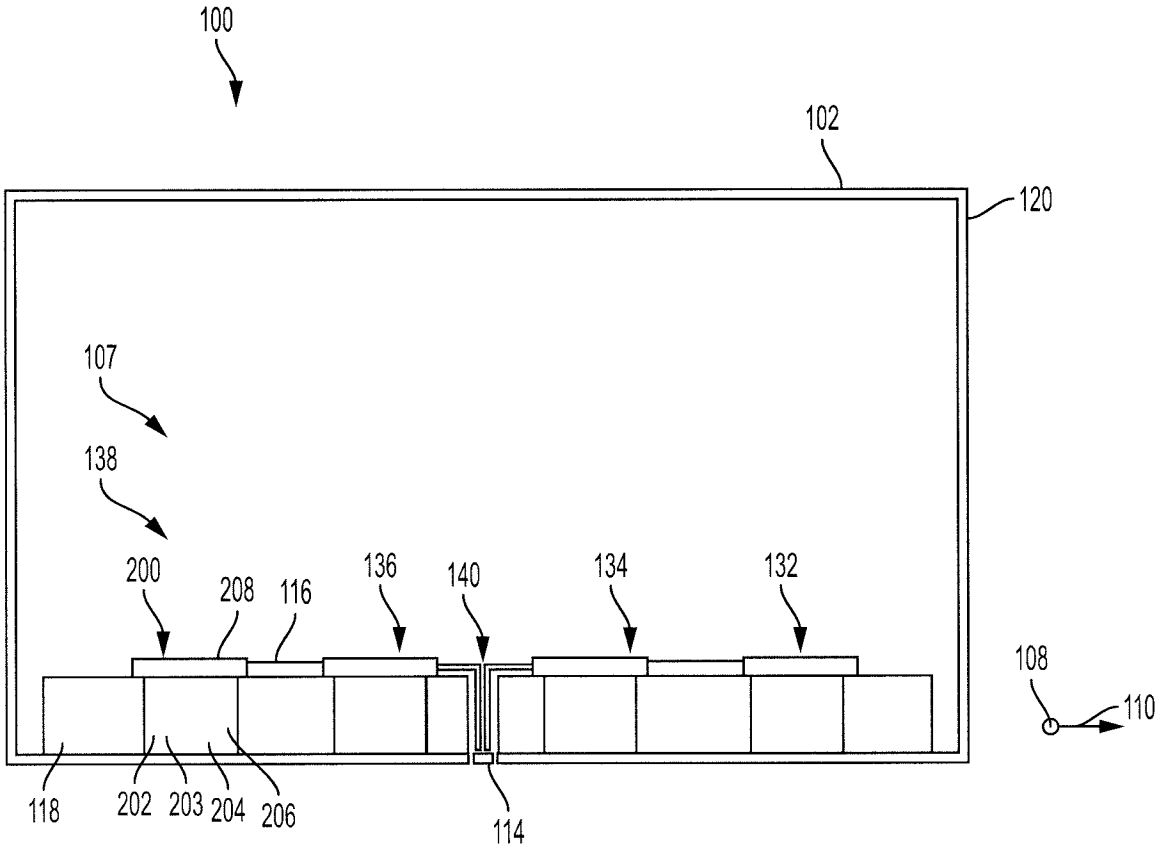
FIG. 2 is a cross-sectional view of the tunable filter of FIG. 1 according to an embodiment of the present disclosure.
Figure 4:
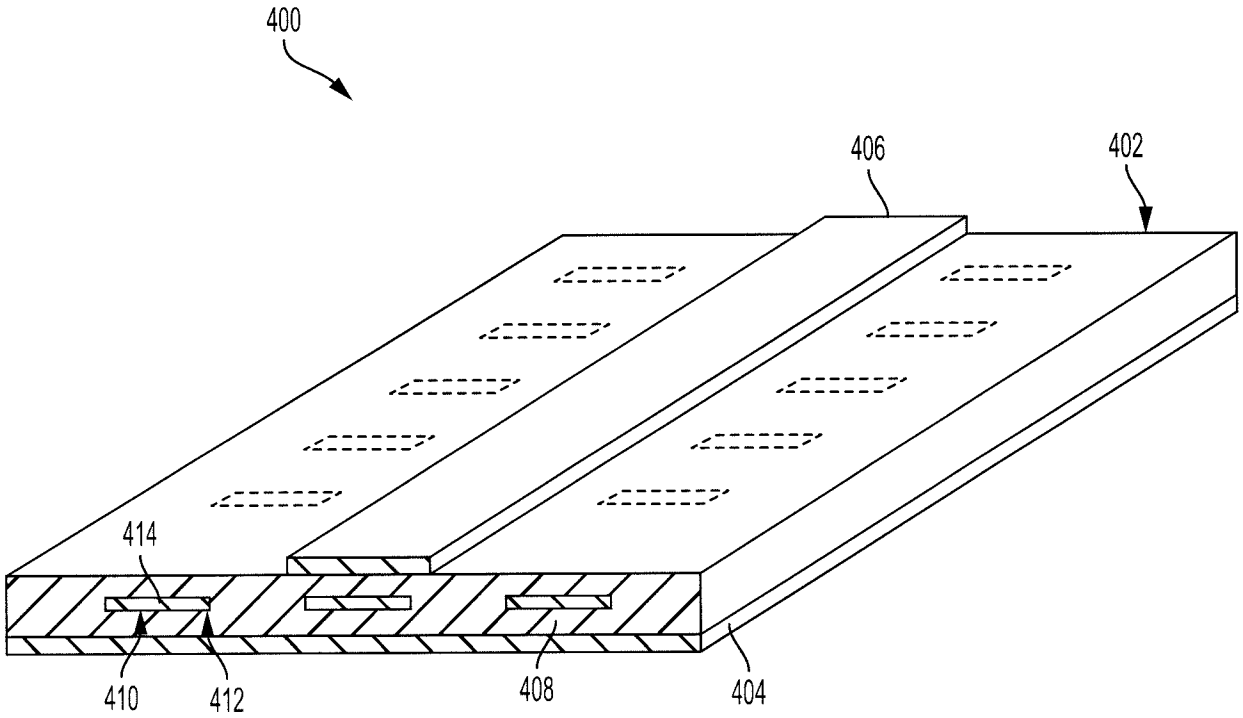
FIG. 4 is a perspective view of a tunable filter oriented along a strip line or a microstrip transmission line according to an embodiment of the present disclosure.
Figure 5:
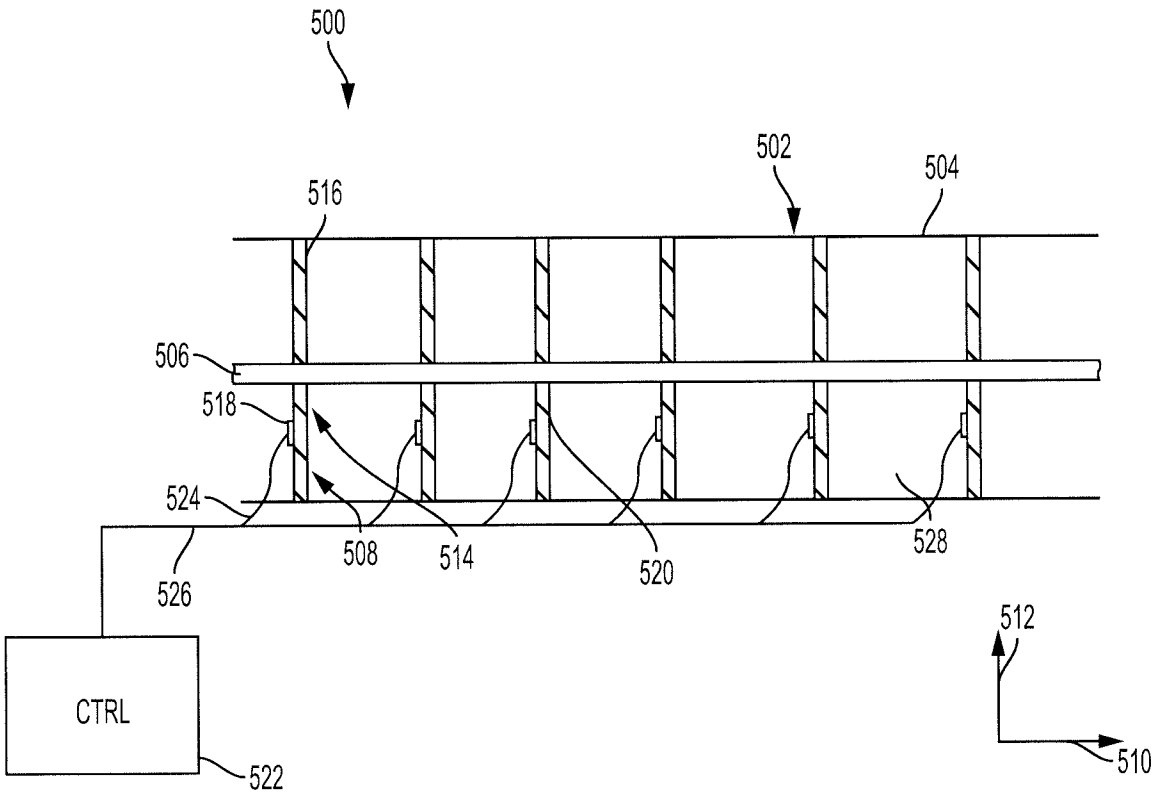
FIG. 5 is a drawing illustrating a cutaway view of a tunable filter implemented along a coaxial transmission line according to an embodiment of the present disclosure.
Figure 6:
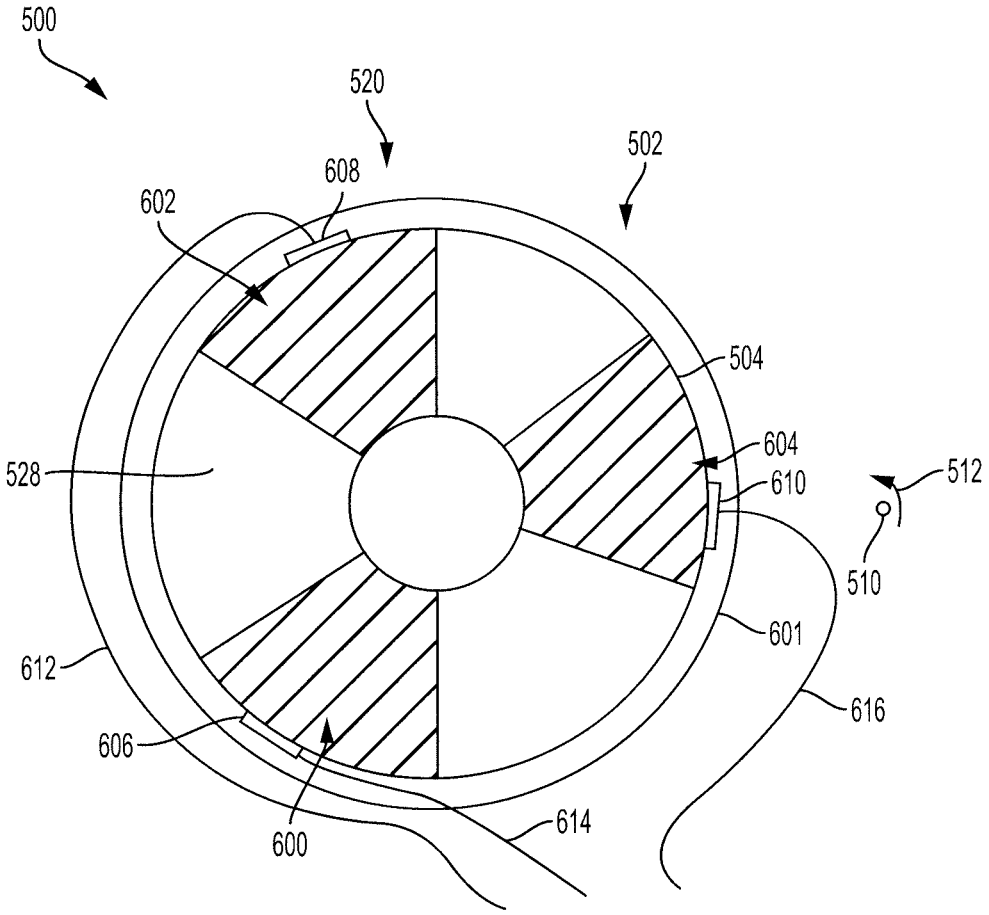
FIG. 6 is a cross-sectional view of the tunable filter of FIG. 5 according to an embodiment of the present disclosure.

The transmission line 102 may include any transmission line. For example and as shown in FIG. 1, the transmission line 102 may include a rectangular waveguide 120 (as shown in FIGS. 1 and 2). However, the present disclosure may be implemented on any type of transmission line such as a coaxial transmission line (as shown in FIGS. 5 and 6), a strip transmission line (such as shown in FIG. 4 and including, for example, a strip line transmission line, or a microstrip transmission line), a ridge waveguide structure, or the like.

The tunable filter 100 may have a longitudinal axis 104 and may further include a two-dimensional capacitor array 106 including a plurality of step-tunable capacitors 107. The two-dimensional capacitor array 106 may include a first dimension 108 that lies parallel to the longitudinal axis 104, and may include a second dimension 110 that is perpendicular or orthogonal to the longitudinal axis 104.

The plurality of step-tunable capacitors 107 may be located on an inside of an H-plane surface of the waveguide 120 and may be spaced apart along the first dimension 108 and along the second dimension 110. The location of each of the plurality of step-tunable capacitors 107 may be arbitrary. In that regard, the plurality of step-tunable capacitors 107 may form the two-dimensional capacitor array 106 having evenly spaced step-tunable capacitors 107 along the first dimension 108 and along the second dimension 110.

Each of the plurality of step-tunable capacitors 107 may be spaced apart by a first distance 112 along the first dimension 108 and by a second distance 113 along the second dimension 110. The first distance 112 and the second distance 113 may correspond to a distance between the centers of adjacent step-tunable capacitors 107.

In some embodiments, the first distance 112 may be the same between each adjacent step-tunable capacitor 107 along the first dimension 108. In some embodiments, the second distance 113 may be the same between each adjacent step-tunable capacitor 107 along the second dimension 110. The first distance 112 may be equal to the second distance 113, or the first distance 112 may be equal to a value that is less than or greater than the second distance 113.

The tunable filter 100 may be designed to provide an adjustable filter response between a minimum frequency and a maximum frequency. In some embodiments, the first distance 112 may be equal to or less than one eighth of a wavelength in the transmission line that corresponds to the maximum frequency. For example, if the maximum frequency is 20 gigahertz (GHz) and the primary transmission line media is air then the corresponding wavelength in the air is 15.0 millimeters (mm, 0.591 inches), and the first distance 112 may be equal to or less than 1.88 mm (0.0740 inches). In some embodiments, the second distance 113 may also be equal to or less than ⅛ of a wavelength that corresponds to the maximum frequency. In some embodiments, the second distance 113 may be equal to or less than one fourth, one fifth, one sixth, one tenth, or the like of the size of the wavelength that corresponds to the maximum frequency. However, it is desirable for the first distance 112 to be equal to or less than ⅛ of the wavelength that corresponds to the maximum frequency.

The two-dimensional capacitor array 106 may include any quantity of step-tunable capacitors 107 along the second dimension 110. An increased quantity of capacitors along the second dimension improves accuracy of tuning the magnitude of the discontinuities.

As shown in FIG. 1, the quantity of step-tunable capacitors 107 along the second dimension 110 is four. In that regard, the two-dimensional capacitor array 106 includes a first row of step-tunable capacitors 132, a second row of step-tunable capacitors 134, a third row of step-tunable capacitors 136, and a fourth row of step-tunable capacitors 138. As the quantity of step-tunable capacitors 107 increases along the second dimension (i.e., as more rows of step-tunable capacitors 134 are added), a magnitude of reflection and a resolution of the tunable filter 100 may be increased, thus increasing accuracy of the tunable filter 100.

The tunable filter 100 may have a length 130. In some embodiments, the length 130 may be at least twice as long, or three times as long, or four times as long, as a wavelength corresponding to the minimum frequency. The length 130 of the tunable filter may be set based on multiple variables such as the operating frequency range, the complexity of the desired filter characteristics, and the performance of the tunable elements. Lower frequency, complex filtering, and smaller impedance change per element in the longitudinal direction may all contribute to an increased length 130.

In some embodiments and referring to FIGS. 1 and 2, the tunable filter 100 may include a nonconductive matrix 118. The nonconductive matrix 118 may define a plurality of openings 202 that are each designed to receive at least a portion of one of the plurality of step-tunable capacitors 107. For example, a first opening 203 is designed to receive a first step-tunable capacitor 200. The nonconductive matrix 118 may include any nonconductive material. For example, the nonconductive matrix 118 may include a polymer, a plastic, a glass, an acrylic, or the like.

The step-tunable capacitor 200 may include similar features as the remaining step-tunable capacitors 107. In that regard, the step-tunable capacitor 200 may include a material 206 having a variable dielectric constant and a conductive electrode 208. The conductive electrode 208 may include any conductive material, such as a metal. For example, the conductive electrode 208 may include copper, brass, tin, aluminum, gold, silver, or the like. In some embodiments, the conductive electrode 208 may include a copper or other material plated with gold to increase conductivity and reduce the likelihood of corrosion.

The material 206 may be a dielectric material that has a variable dielectric constant. For example, the dielectric constant of the material 206 may vary in response to a change in voltage, or bias, applied to the material 206. Example materials that have variable dielectric constants include liquid crystals (LC), ceramics, junction diodes (such as a varicap or a varactor diode), or the like. In some embodiments, liquid crystals may be desirable. This may be due to the relatively low cost of liquid crystals and the ease of manufacturing using liquid crystals.

Individual bias lines 116 may be connected to each of the conductive electrodes 208 and may be used to convert each of the step-tunable capacitors 107 between a biased mode and an unbiased mode. When a step-tunable capacitor 107 is in a biased mode, it may provide a different impedance at its specific location along the transmission line 102 than when it is in an unbiased mode. Stated differently, each step-tunable capacitor 107 may have a first impedance value when biased and a second impedance value that is different than the first impedance value when unbiased.

Each of the step-tunable capacitors 107 may be placed in the biased mode by either applying a voltage to the corresponding conductive electrode 208 or by removing a voltage from the corresponding conductive electrode 208. Each of the step-tunable capacitors 107 may be placed in the unbiased mode by the other of applying the voltage to the corresponding conductive electrode 208 or by removing the voltage from the corresponding conductive electrode 208.

In some embodiments, each of the step-tunable capacitors 107 may have varying degrees of bias. For example, the step-tunable capacitors 107 may be unbiased, may be biased to a first biasing magnitude that corresponds to a first impedance, and may be biased to a second biasing magnitude that corresponds to a second impedance that is different than the first impedance. The degree of biasing of each of the step-tunable capacitors 107 may be based on the amount of voltage applied to the corresponding conductive electrode 208.

In some embodiments, each of the plurality of step-tunable capacitors 107 may have a same shape and size. The shape and/or size of the step-tunable capacitors 107 may vary based on tolerances in manufacturing techniques. Because each of the step-tunable capacitors 107 can have a different biasing magnitude, they may be manufactured to have the same shape and size and still produce varying degrees of impedance. Because each of the plurality of step-tunable capacitors 107 may be formed in the same way, manufacturing costs may be reduced.

Each of the conductive electrodes 208 may be connected to an individual bias line 116. Each of the bias lines 116 may connect one of the plurality of step-tunable capacitors 107 to the controller 122, either directly or indirectly. For example, each of the individual bias lines 116 may be coupled to a bus 114, which is then coupled to the controller 122. The bus 114 may then transfer the data from each of the bias lines 116 to the controller 122. In that regard, the controller 122 may control the biased mode (whether each step-tunable capacitor 107 is biased or unbiased) and the biasing magnitude (a magnitude of the bias) by applying a specific voltage to the corresponding conductive electrode 208 of each of the plurality of step-tunable capacitors 107. In that regard, the controller 122 may control the tunable filter 100 to function to achieve any desired frequency response by controlling the biasing of each of the step-tunable capacitors 107.

The matrix 118 may define a gap 140 between any two or more rows of the step-tunable capacitors. For example, the gap 140 shown in FIG. 1 is located between the second row of step-tunable capacitors 134 and the third row of step-tunable capacitors 136. The gap 140 may provide a location through which each of the individual bias lines 116 (and potentially the bus 114) may extend.

Although the two-dimensional capacitor array 106 is illustrated along an H plane of the waveguide 120, one skilled in the art will realize that a tunable filter 100 may include a two-dimensional capacitor array located elsewhere in the waveguide 120 and still perform the same functionality.

The controller 122 may adjust both the magnitude and position of the corresponding waveguide discontinuities by selecting which of the step-tunable capacitors 107 to bias. Because each step-tunable capacitor 107 of the two-dimensional capacitor array 106 may have a fine pitch (i.e., relatively small spacing between step-tunable capacitors 107), both position and magnitude of desired impedance can be achieved. Because the two-dimensional array can be formed with relatively high resolution methods (such as photolithography), relatively fine pitch may be achieved (e.g., LCD display panels are manufactured with several hundred or even several thousand pixels per inch).

Tuning of the tunable filter 100 may be limited by the speed of switching of the step-tunable capacitors 107 between the biased mode and the unbiased mode, and between biasing magnitudes. For example, this switching may occur in milliseconds.

Filter characteristics that can be achieved by this structure are limited by the maximum size of the achievable discontinuity and by RF loss concerns that limit the usable length of the two-dimensional capacitor array 106. LC materials have limited dielectric constant variation with bias and the loss of the structure may be set by the loss tangent of the LC and matrix materials, resistive loss in the electrode material, losses due to the bias network structure (not shown), and the relative thickness of the structure in the guide. One example LC material designed for microwave use has Er=2.77, tand=0.0055 in one state, and Er=2.13, tand=0.0112 in the other state. Other materials with variable dielectric constant have corresponding Er and tand values that may provide different constraints on filter size and loss. Periodic biasing of the example material in a representative waveguide structure at half wavelength intervals results in a low loss band reject filter characteristic, and other filter characteristics can be synthesized by superposition or by using Fourier transform or other known methods.

The tunable filter 100 may include various components for controlling its operation. For example, the tunable filter 100 may include a frequency response device or component 126 capable of receiving a desired frequency response for example, the device or component 126 may include an input device, a memory, or the like.

The controller 122 may include any computation device. The computation device 122 may include one or more of a logic or non-transitory memory storage device capable of performing logic functions or storing data.

In particular, the computation device 122 may include a memory capable of storing one or more stored patterns 124, a logic device capable of calculating one or more patterns 125, and a pattern definition algorithm 128. Each of the stored patterns 124 may correspond to a desired frequency response of the tunable filter 100. In that regard, in response to receiving a desired frequency response from the device or component 126 (such as an input device), the pattern definition algorithm 128 may analyze the stored patterns 124 to identify whether one or more of the stored patterns 124 corresponds to the desired frequency response. If a match is found, the pattern definition algorithm 128 may transmit the stored pattern to the bus 114 via a driver 129 in order to cause the transmission line 102 to provide the desired frequency response.

The logic device capable of calculating one or more patterns 125 may be capable of identifying one or more pattern that corresponds to a desired frequency response. In that regard, in response to receiving a desired frequency response from the device or component 126, the pattern definition algorithm 128 may provide the desirable frequency response to the logic device capable of calculating one or more patterns 125 which may identify a pattern that corresponds to the desired frequency response. The logic device capable of calculating one or more patterns 125 may then transmit the pattern to the pattern definition algorithm 128 which may then transmit the pattern to the driver 129 which causes the transmission line 102 to implement the desired pattern in order to achieve the desired frequency response.

In some embodiments, system performance feedback 131 may be received from the RF system containing the filter and may be transmitted to the device or component 126 capable of receiving system performance feedback. Based on the received feedback 131, the device or component 126 capable of receiving feedback may adjust the desired frequency response and transmit the adjusted frequency response to the computation device 122 and order to cause the transmission line 102 to achieve the new desired frequency response with the goal of improving system performance.

Figure 3:
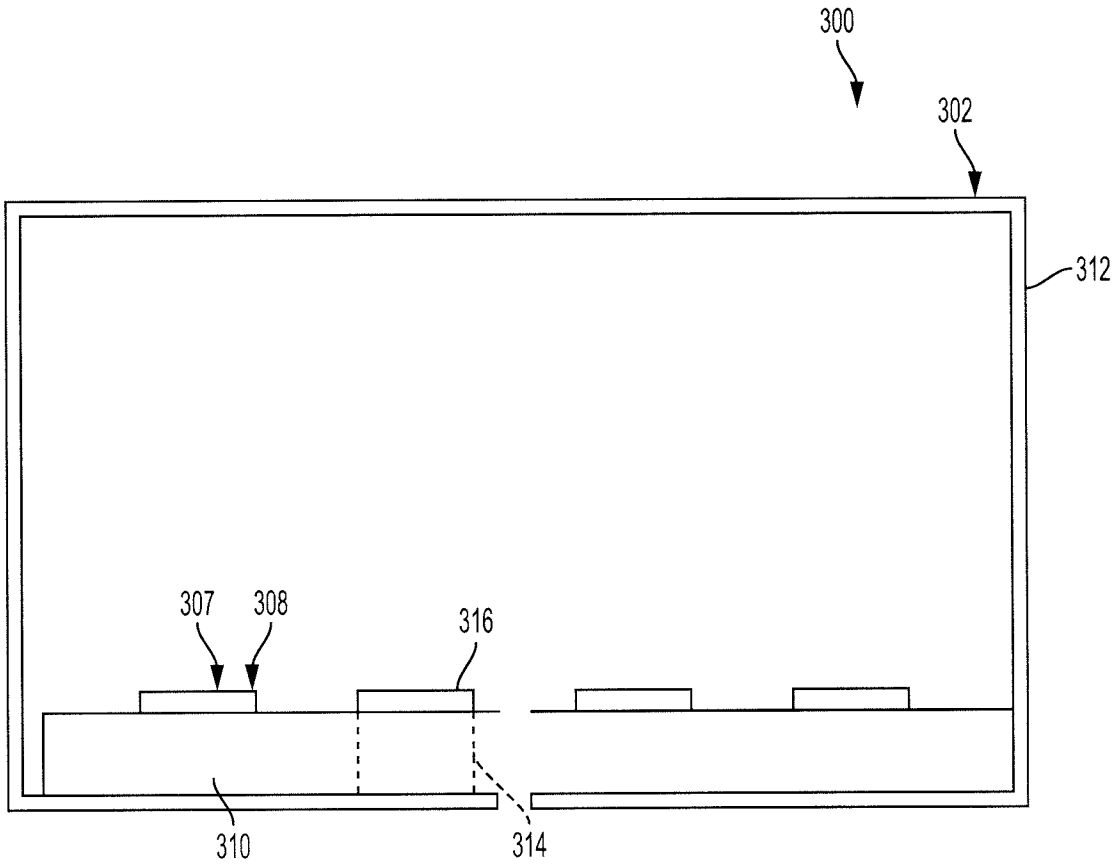
FIG. 3 is a cross-sectional view of a tunable filter having a single layer of material with a variable dielectric constant according to an embodiment of the present disclosure.

Turning now to FIG. 3, another tunable filter 300 may likewise use a waveguide 312 as a transmission line 302. However, the tunable filter 300 fails to include a matrix and may include a single layer of material having a variable dielectric constant. A plurality of step-tunable capacitors 307 may be formed by placing conductive electrodes 308 at locations along the single layer of material 310 at which a step-tunable capacitor is desired.

Although the material 310 of each of the plurality of step-tunable capacitors 307 is continuous (i.e., the material 310 of each step-tunable capacitor 307 is in contact with the material 310 of an adjacent step-tunable capacitor 307), the step-tunable capacitors 307 are separated by spacing of the conductive electrode 308. In that regard, a section 314 of the material 310 that is aligned with a corresponding conductive electrode 316 may provide step-tunable impedance when the corresponding conductive electrode 316 is provided with a voltage.

Turning now to FIG. 4, another tunable filter 400 is shown. The tunable filter 400 includes a strip line or microstrip (strip) transmission line 402, as opposed to the waveguide 120 of the transmission line 102 of FIG. 1. The strip transmission line 402 includes a ground plane 404, a conductor 406, and a substrate 408. The substrate 408 may be formed of a material having a variable dielectric constant. The substrate 408 may be located between the ground plane 404 and the conductor 406.

The tunable filter 400 may further include a two-dimensional capacitor array 410 including a plurality of step-tunable capacitors 412. Each of the plurality of step-tunable capacitors 412 may include a conductive electrode 414. The conductive electrode 414 of each of the plurality of step-tunable capacitors 412 may be coupled to a controller (not shown). In that regard, each of the plurality of step-tunable capacitors 412 may be controlled to be in a biased mode or an unbiased mode, and may be controlled to have one of a plurality of biasing magnitudes.

Referring now to FIGS. 5 and 6, another tunable filter 500 is shown. The tunable filter 500 includes a coaxial transmission line 502. The coaxial transmission line 502 includes a coaxial outer conductor 504, which may be coupled to an electronic ground. The coaxial transmission line 502 further includes a coaxial pin 506 located radially inward and separated from the coaxial outer conductor 504.

The tunable filter 500 may include a two-dimensional capacitor array 508 that includes a plurality of step-tunable capacitors 514. The two-dimensional capacitor array 508 may extend along a first dimension 510 (i.e., parallel to a longitudinal axis of the coaxial transmission line 502) and a second dimension 512. As shown, the second dimension 512 may be a circumferential dimension, which is perpendicular or orthogonal to the first dimension 510.

The plurality of step-tunable capacitors 514 may be spaced apart along the first dimension 510 and along the second (i.e., circumferential) dimension 512. For example, multiple sets 520 of step-tunable capacitors 514 may be spaced apart along the first dimension 512. Each of the sets 520 may include a first step-tunable capacitor 600, a second step-tunable capacitor 602, and a third step-tunable capacitor 604 spaced around the second dimension 512. In some embodiments, each of the sets 520 may include one, two, or more step-tunable capacitors 514.

Each of the step-tunable capacitors 514 may include a material 516 having a variable dielectric constant along with a corresponding electrode 518. In some embodiments, a space 528 between the material 516 of each of the step-tunable capacitors 514 may include air, may include another non-conductive or dielectric material, or may include the same material 516 as the step-tunable capacitors.

The electrode 518 of each of the plurality of step-tunable capacitors 514 may be coupled to a controller 522 via a plurality of bias lines 524. For example, the first step-tunable capacitor 600 may include a first electrode 606 coupled to a first bias line 614, the second step-tunable capacitor 602 may include a second electrode 608 coupled to a second bias line 612, and the third step-tunable capacitor 604 may include a third electrode 610 coupled to a third bias line 616. The bias lines 524 from each of the plurality of step-tunable capacitors 514 may be coupled to the controller 522 via a bus 526.

Figure 7:
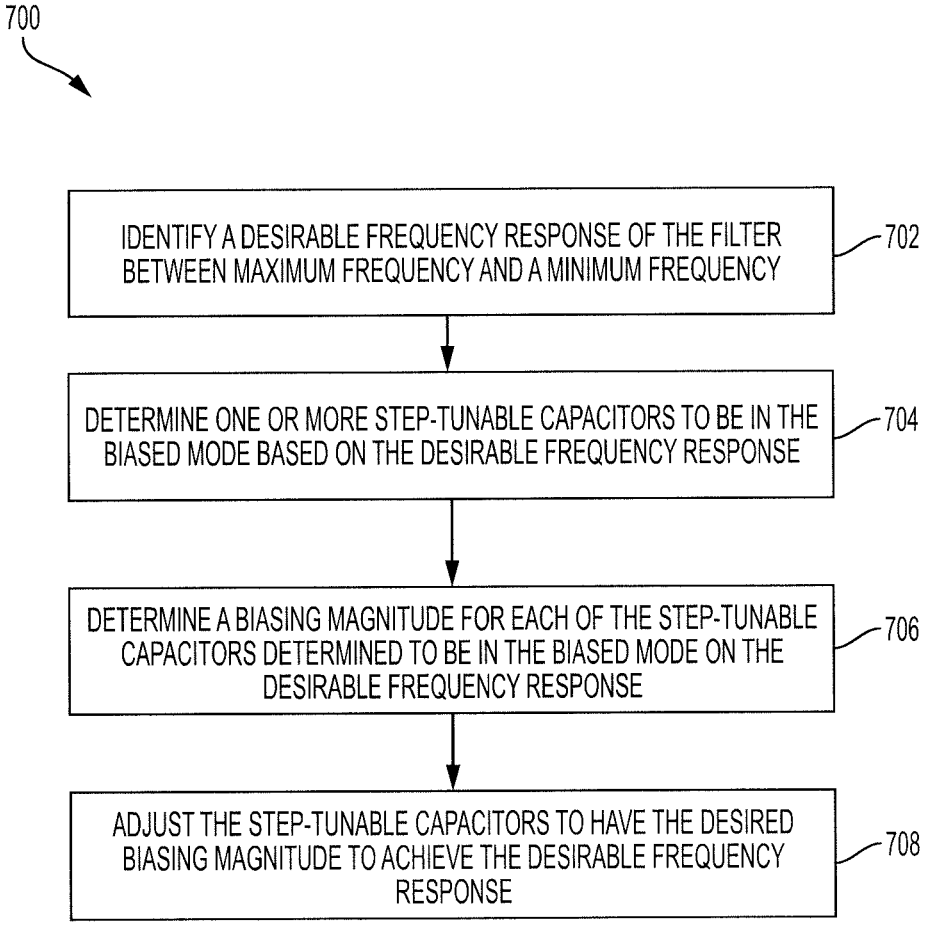
FIG. 7 is a flowchart illustrating a method for controlling operation of a tunable filter according to an embodiment of the present disclosure.

Turning now to FIG. 7, a method 700 for controlling a tunable filter (such as the tunable filter 100 of FIG. 1, the tunable filter 300 of FIG. 3, the tunable filter 400 of FIG. 4, or the tunable filter 500 of FIG. 5) is shown. The method 700 may be performed by a controller coupled to each of a plurality of step-tunable capacitors.

In block 702, a desirable frequency response of the tunable filter may be identified. The desirable frequency response may be selected to perform a filtering operation between a maximum frequency of the tunable filter and a minimum frequency of the tunable filter. For example, the desirable frequency response of the tunable filter may be received via an input device. The desirable frequency response may further include desirable filter operation such as whether a bandpass or a band stop filter is desired.

In block 704, the controller may determine one or more step-tunable capacitor to be in the biased mode based on the desirable frequency response. For example, the controller may determine which one or more step-tunable capacitor to be in the biased mode based on an algorithm stored in a memory or based on other data.

In block 706, the controller may determine a biasing magnitude for each of the step-tunable capacitors that is determined to be in the biased mode based on the desirable frequency response. The biasing magnitude may be determined, for example, based on an algorithm stored in a memory or based on other data.

In block 708, the controller may control each of the step-tunable capacitors to have the desired biasing magnitude to cause the tunable filter to achieve the desirable frequency response. For example, the controller may cause a voltage signal to be transmitted to each of the step-tunable capacitors based on the desired biasing magnitude.

Where used throughout the specification and the claims, "at least one of A or B" includes "A" only, "B" only, or "A and B." Exemplary embodiments of the methods/systems have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A tunable filter for providing an adjustable filter response between a minimum frequency and a maximum frequency, the tunable filter comprising:

a transmission line configured to transmit a signal and having longitudinal axis;

a two-dimensional capacitor array including a plurality of tunable capacitors located along the transmission line, a first dimension of the two-dimensional capacitor array being along the longitudinal axis and a second dimension of the two-dimensional capacitor array being located perpendicular to the longitudinal axis, each of the plurality of tunable capacitors includes a material having a variable dielectric constant and a conductive electrode; and a controller coupled to each of the plurality of tunable capacitors and configured to control each of the plurality of tunable capacitors independently to be in a biased mode or in an unbiased mode based on a desired frequency response of the tunable filter, the controller configured to control each of the plurality of tunable capacitors to be in the biased mode by at least one of providing a voltage to a corresponding conductive electrode or removing the voltage from the corresponding conductive electrode.

2. The tunable filter of claim 1 wherein the plurality of tunable capacitors are equally spaced apart in at least one of first dimension or the second dimension.

3. The tunable filter of claim 2 wherein each of the plurality of tunable capacitors is spaced apart in the first dimension by a distance that is equal to or less than one eighth of a wavelength corresponding to the maximum frequency.

4. The tunable filter of claim 1 further comprising a matrix having insulating properties and defining openings for receiving the material having the variable dielectric constant of each of the plurality of tunable capacitors.

5. The tunable filter of claim 1 wherein the material of each of the plurality of tunable capacitors includes a liquid crystal material and the conductive electrode includes a metal material.

6. The tunable filter of claim 1 wherein the material of each of the plurality of tunable capacitors is in contact with the material of an adjacent tunable capacitor, such that each of the plurality of tunable capacitors is distinguished by spacing of the conductive electrode of each of the plurality of tunable capacitors.

7. The tunable filter of claim 1 wherein the plurality of tunable capacitors extends for a length in the first dimension that is equal to or greater than two wavelengths of the minimum frequency.

8. The tunable filter of claim 1 wherein the transmission line includes at least one of a waveguide, a coaxial transmission line, a stripline transmission line, or a microstrip transmission line.

9. The tunable filter of claim 1 wherein the tunable filter is configured to change filter behavior at relatively high speeds in order to modulate or demodulate signals as well as to perform static or slowly-varying filter functions.

10. The tunable filter of claim 1 further comprising a frequency response device configured to select a new desirable frequency response based on received feedback corresponding to system performance with a previous desirable frequency response.

11. A tunable filter for providing an adjustable filter response, the tunable filter comprising:

a transmission line configured to transmit a signal and having longitudinal axis, the transmission line including at least one of a waveguide, a coaxial transmission line, a stripline transmission line, or a microstrip transmission line;

a two-dimensional capacitor array including a plurality of tunable capacitors located along the transmission line, a first dimension of the two-dimensional capacitor array being along the longitudinal axis and a second dimension of the two-dimensional capacitor array being located perpendicular to the longitudinal axis, each of the plurality of tunable capacitors being equally spaced apart in the first dimension; and a controller coupled to each of the plurality of tunable capacitors and configured to control each of the plurality of tunable capacitors to be in a biased mode or in an unbiased mode based on a desired frequency response of the tunable filter.

12. The tunable filter of claim 11 wherein the plurality of tunable capacitors are equally spaced apart in the second dimension.

13. The tunable filter of claim 11 wherein:

each of the plurality of tunable capacitors includes a material having a variable dielectric constant and a conductive electrode; and the controller is configured to control each of the plurality of tunable capacitors to be in the biased mode by at least one of providing a voltage to a corresponding conductive electrode or removing the voltage from the corresponding conductive electrode.

14. The tunable filter of claim 13 wherein the tunable filter is configured to provide the adjustable filter response between a minimum frequency and a maximum frequency, and the plurality of tunable capacitors extends for a length in the first dimension that is equal to or greater than two wavelengths of the minimum frequency.

15. The tunable filter of claim 11 wherein the tunable filter is configured to provide the adjustable filter response between a minimum frequency and a maximum frequency, and each of the plurality of tunable capacitors is spaced apart in the first dimension by a distance that is equal to or less than one eighth of a wavelength corresponding to the maximum frequency.

16. A transmission line tunable filter for adjusting impedance of a transmission line, the transmission line tunable filter comprising:

an array of tunable capacitors each operating as a variable dielectric element and being configured to be in an unbiased mode or a biased mode, each tunable capacitor providing different impedance in the biased mode than in the unbiased mode; and a controller connected to the array of tunable capacitors, the controller configured to:

determine one or more tunable capacitors in the array of tunable capacitors to be in the biased mode based on a desired frequency response, determine a biasing magnitude for each of the determined one or more tunable capacitors in the biased mode based on the desired frequency response, and adjust the determined one or more tunable capacitors to be in the biased mode at the respective determined biasing magnitude.

17. The transmission line tunable filter of claim 16 wherein the transmission line is at least one of a waveguide, a coaxial transmission line, a stripline transmission line, or a microstrip transmission line.

18. The transmission line tunable filter of claim 16 further comprising a non-conductive matrix having a plurality of openings that define a plurality of cavities each configured to receive one of the array of tunable capacitors.

19. The transmission line tunable filter of claim 16 wherein the transmission line is a waveguide and the array of tunable capacitors includes at least two rows of tunable capacitors separated by a gap configured to receive a plurality of bias lines that electrically connect each of the array of tunable capacitors to the controller.

* * * * *